US011971023B2

(12) United States Patent
Xiong et al.

(10) Patent No.: US 11,971,023 B2
(45) Date of Patent: Apr. 30, 2024

(54) MINIATURE ELECTROMAGNETIC WATER PUMP

(71) Applicant: ShenZhen CNHT Limited Company, Guangdong (CN)

(72) Inventors: Yingshen Xiong, Guangdong (CN); Liqiang Lei, Guangdong (CN); Wu Zhou, Guangdong (CN); Huanlu Lu, Guangdong (CN)

(73) Assignee: ShenZhen CNHT Limited Company, Guangdong (CN)

( * ) Notice: Subject to any disclaimer, the term of this patent is extended or adjusted under 35 U.S.C. 154(b) by 155 days.

(21) Appl. No.: 17/626,207

(22) PCT Filed: Jul. 23, 2019

(86) PCT No.: PCT/CN2019/097289
§ 371 (c)(1),
(2) Date: Jan. 11, 2022

(87) PCT Pub. No.: WO2021/007878
PCT Pub. Date: Jan. 21, 2021

(65) Prior Publication Data

US 2022/0275795 A1 Sep. 1, 2022

(30) Foreign Application Priority Data

Jul. 16, 2019 (CN) ..... 201921116497.8

(51) Int. Cl.
*F04B 17/03* (2006.01)
*F04B 11/00* (2006.01)
(Continued)

(52) U.S. Cl.
CPC ..... *F04B 17/03* (2013.01); *F04B 11/0091* (2013.01); *F04B 17/04* (2013.01);
(Continued)

(58) Field of Classification Search
CPC ..... F04B 17/03; F04B 17/04; F04B 17/042; F04B 17/044; F04B 17/046; F04B 49/225; F04B 11/0091; F04B 39/0055
See application file for complete search history.

(56) References Cited

U.S. PATENT DOCUMENTS 2,851,058 A * 9/1958 Rumsey ..... F04B 11/0091 138/26
3,958,902 A * 5/1976 Toyoda ..... F04B 49/225 417/279

(Continued)

FOREIGN PATENT DOCUMENTS

CN 200999708 Y 1/2008
CN 201330687 Y 10/2009

(Continued)

OTHER PUBLICATIONS

International Search Report issued by the China National Intellectual Property Administration, as the International Searching Authority, in International Application No. PCT/CN2019/097289 dated Apr. 17, 2020, 7 pages.

(Continued)

*Primary Examiner* — Christopher S Bobish
(74) *Attorney, Agent, or Firm* — Gesmer Updegrove LLP

(57) ABSTRACT

The present utility model relates to the technical field of water pumps, and more particularly, to a miniature electromagnetic water pump, which includes a pump body, a magnetic core plunger device installed in the pump body, an electromagnetic device sleeved outside the pump body, and a throttle valve device connected with the magnetic core plunger device, the magnetic core plunger device is used to pump the liquid outside the pump body to the throttle valve device, the electromagnetic device generates a pulsed electromagnetic field to push the magnetic core plunger device to reciprocate in the pump body, the miniature electromag- (Continued)

netic water pump of the present utility model has the advantages of stable liquid output and good liquid flow continuity.

10 Claims, 3 Drawing Sheets

(51) Int. Cl.
*F04B 17/04* (2006.01)
*F04B 39/00* (2006.01)
*F04B 49/22* (2006.01)

(52) U.S. Cl.
CPC ..... *F04B 17/042* (2013.01); *F04B 17/044* (2013.01); *F04B 17/046* (2013.01); *F04B 39/0055* (2013.01); *F04B 49/225* (2013.01)

(56) References Cited

U.S. PATENT DOCUMENTS 4,201,522 A * 5/1980 Toyota ..... F04B 17/042 431/38
4,514,151 A * 4/1985 Anders ..... F04B 11/0091 138/30
5,379,593 A * 1/1995 Ishiwata ..... B60T 8/4068 60/413
6,062,831 A * 5/2000 Konishi ..... F02M 59/44 417/540
7,237,474 B2 * 7/2007 Schlitzkus ..... F04B 11/0091 92/78
7,802,557 B2 * 9/2010 Mattioli ..... F04B 17/046 123/499

FOREIGN PATENT DOCUMENTS

CN 202176475 U 3/2012
JP 07229474 A 8/1995
WO 2014163000 10/2014

OTHER PUBLICATIONS

English Translation of the International Search Report issued by the China National Intellectual Property Administration, as the International Searching Authority, in International Application No. PCT/CN2019/097289 dated Apr. 17, 2020, 2 pages.

* cited by examiner

MINIATURE ELECTROMAGNETIC WATER PUMP

CROSS-REFERENCE TO RELATED APPLICATIONS

The present application is a U.S. National Stage filing under 35 U.S.C. 371(c) of International Application No. PCT/CN2019/097289, filed Jul. 23, 2019, which claims priority to Chinese Application No. 201921116497.8, filed Jul. 16, 2019, the disclosures of which are hereby incorporated by reference in their entireties.

TECHNICAL FIELD

The utility model relates to the technical field of water pumps, and more particularly, to a miniature electromagnetic water pump.

BACKGROUND

Currently, small plunger-type electromagnetic water pumps have been widely used in various fields, especially, miniature plunger-type water pumps have been widely used due to their compact and precise structure, and they can be used in products such as coffee machines and steam generators. The plunger of the plunger-type electromagnetic water pump reciprocates by means of electromagnetic force and spring force, such that water is sucked in from a water inlet and pumped out via a water outlet.

Each time the plunger in the electromagnetic pump runs back and forth, a unit flow of liquid will be pumped out from the water outlet. It works in a pulsed working manner, if this power-on pulse and power-off pulse are given continuously, the pump can pump the liquid continuously in a pulsed manner. However, the reciprocating movement of the plunger requires a certain period of time, which results in unstable flow of the liquid at the water outlet and poor flow continuity.

SUMMARY

In order to overcome the shortcomings of the prior art, the present utility model provides a miniature electromagnetic water pump, which has the advantages of stable liquid output and good liquid flow continuity.

The technical solutions adopted by the present utility model to solve the technical problems are:

A miniature electromagnetic water pump, which includes a pump body, a magnetic core plunger device installed in the pump body, an electromagnetic device sleeved outside the pump body, and a throttle valve device connected with the magnetic core plunger device, wherein the magnetic core plunger device is used to pump the liquid outside the pump body to the throttle valve device, the electromagnetic device generates a pulsed electromagnetic field to push the magnetic core plunger device to reciprocate in the pump body;

the throttle valve device includes a throttle valve seat, an containing groove provided on the throttle valve seat, and a throttle valve cover arranged in the containing groove, the throttle valve seat is provided with a liquid inlet hole for liquid to flow into the containing groove, the cross section of the throttle valve cover is in a concave shape, a rubber sheet is clamped in the throttle valve cover, a flow restricting ring is circumferentially provided in the containing groove close to an opening edge of the liquid inlet hole, the flow restricting ring, the containing groove and the rubber sheet define a first flow restricting cavity, a second flow restricting cavity is enclosed by the side of the rubber sheet away from the liquid inlet hole and the inner wall of the throttle valve cover, and a buffer channel is enclosed by the inner side wall of the containing groove and the outer side wall of the throttle valve cover, the first flow restricting cavity and the second flow restricting cavity are respectively communicated with the liquid inlet and the liquid outlet of the buffer channel, the throttle valve cover is provided with a liquid discharging opening for the liquid in the second flow restricting cavity to be discharged from the throttle valve device.

Wherein, the electromagnetic device comprises a framework sleeved outside the pump body, a coil wound on the framework, and a housing covering the coil.

Wherein, a magnetic yoke ring is provided between the framework and the pump body.

Wherein, the pump body has a tubular structure with two open ends, the two ends of the pump body are the liquid inlet end and the liquid outlet end respectively, the magnetic core plunger device comprises a core slidably arranged in the pump body, a reset spring connected to the liquid inlet end of the pump body, which tends to move the core toward the liquid outlet end of the pump body, a sleeve arranged at the liquid outlet end of the pump body, and a coupler sleeved on the sleeve, the core is hollow inside and formed with a flow channel for liquid to flow through, and an inner cavity between the end of the core close to the liquid outlet end of the pump body and the sleeve constitutes a pressure cavity, one end of the coupler close to the pump body is fixedly connected to the housing, and the other end extends in a direction away from the pump body and forms a liquid outlet cavity with the end of the sleeve away from the pump body, the end of the sleeve away from the pump body is provided with an axial through hole connecting the pressure cavity and the liquid outlet cavity, and the end of the coupler away from the pump body is connected to the throttle valve seat, one end of the flow channel close to the sleeve is provided with a first one-way valve for blocking the liquid in the liquid outlet cavity from flowing back into the flow channel, a second one-way valve is installed in the liquid outlet cavity to prevent the liquid in the liquid outlet cavity from flowing back into the pressure cavity, and the liquid outlet cavity and the containing groove on the throttle valve seat are communicated through the liquid inlet hole.

Wherein, the first one-way valve comprises a tension spring and a valve core, the tension spring is arranged between the liquid inlet end of the pump body and the valve core, and two ends of the tension spring are respectively connected to the core and the valve core.

Wherein, the second one-way valve is arranged at the connection between the axial through hole of the sleeve and the liquid outlet cavity, the second one-way valve includes a sealant head and a tower spring, two ends of the tower spring are respectively connected with the sealant head and the coupler, and the sealant head is arranged between the sleeve and the tower spring.

Wherein, the throttle valve seat is provided with a connecting part on one side close to the coupler for connecting with the coupler, and the connecting part is threaded to the coupler.

Wherein, the buffer channel is in the shape of a bend line.

Wherein, a first sealing ring is provided between the connecting part and the coupler, and the first sealing ring is used to block the liquid in the liquid outlet cavity from flowing to a gap between the connecting part and the coupler.

Wherein, the outer side wall of the throttle valve cover is provided with a flow blocking component for preventing the liquid in the buffer channel from flowing back into the liquid inlet, and the flow blocking component is arranged between the liquid inlet and the liquid outlet.

The beneficial effects of the present utility model are:

The utility model provides a throttle valve device installed on the coupler of the electromagnetic water pump, and the throttle valve cover of the throttle valve device is provided with a rubber sheet with certain elasticity, thus the throttle valve device can be self-adjusted according to the pressure in the first flow restricting cavity and the pressure in the second flow restricting cavity to keep the pressure of the second flow restricting cavity in a stable state, thereby stabilizing the flow of liquid discharged from the liquid discharging opening, and since the liquid flows from the first flow restricting cavity into the buffer channel for buffering and deceleration and then flows into the second flow restricting cavity, the flow rate of the liquid flowing into the second flow restricting cavity is lower, that is, the change in the flow rate of the liquid flowing into the second flow restricting cavity per unit time is small, so that the pressure change in the second flow restricting cavity per unit time is small, therefore, the change in the flow rate of the liquid discharged from the liquid discharging opening is small. The buffer channel also extends the flow path of the liquid, and the liquid filled in the buffer channel can effectively improve the continuity of liquid discharge.

BRIEF DESCRIPTION OF THE DRAWINGS

The present utility model will be further described below in conjunction with the drawings and embodiments.

Figure 1:
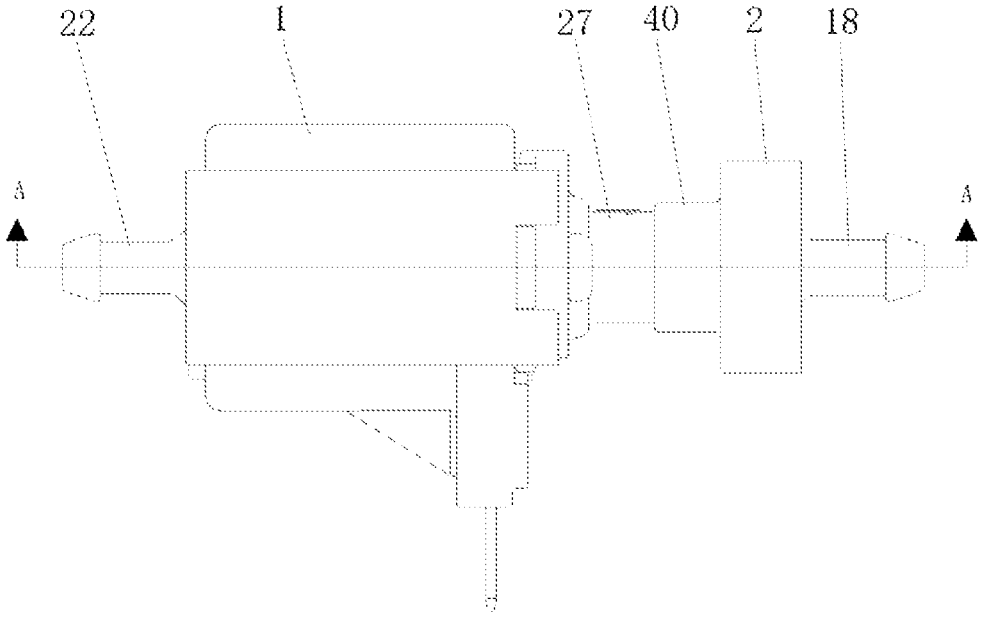
FIG. 1 is a schematic diagram of the overall structure according to an embodiment of the present utility model.

Reference numerals: 1. pump body; 2. throttle valve seat; 3. containing groove; 4. throttle valve cover; 5. liquid inlet hole; 6. rubber sheet; 7. flow restricting ring; 8. first flow restricting cavity; 9. second flow restricting cavity; 10. buffer channel; 11. liquid inlet; 12. liquid outlet; 13. liquid discharging opening; 14. flow blocking component; 15. limiting ring; 17. snap ring; 18. drip tube; 19. framework; 20. coil; 21. housing; 22. liquid inlet end; 23. liquid outlet end; 24. core; 25. reset spring; 26. sleeve; 27. coupler; 28. flow channel; 29. pressure cavity; 30. liquid outlet cavity; 31. axial through hole; 32. first one-way valve; 33. tension spring; 34. valve core; 35. second one-way valve; 36. sealant head; 37. tower spring; 38. magnetic yoke ring; 39. bushing; 40. connecting part; 41. first sealing ring; 42. second sealing ring; 43. third sealing ring.

DETAILED DESCRIPTION

In the following, the concept, specific structure, and technical effects of the present utility model will be clearly and completely described in conjunction with the embodiments and the drawings, so as to fully illustrate the purpose, features and effects of the present utility model. Apparently, the described embodiments are only a part of the embodiments of the present utility model, rather than all the embodiments, based on the embodiments of the present utility model, other embodiments obtained by those skilled in the art without creative work shall fall within the protection scope of the present utility model. In addition, all the connection/connection relationships involved in the application do not only refer to the direct connection of the components, but also refer to the fact that a better connection structure can be formed by adding or reducing connection accessories according to specific implementation conditions. The various technical features in the creation of the present utility model can be combined interactively on the premise of not contradicting each other.

Figure 2:
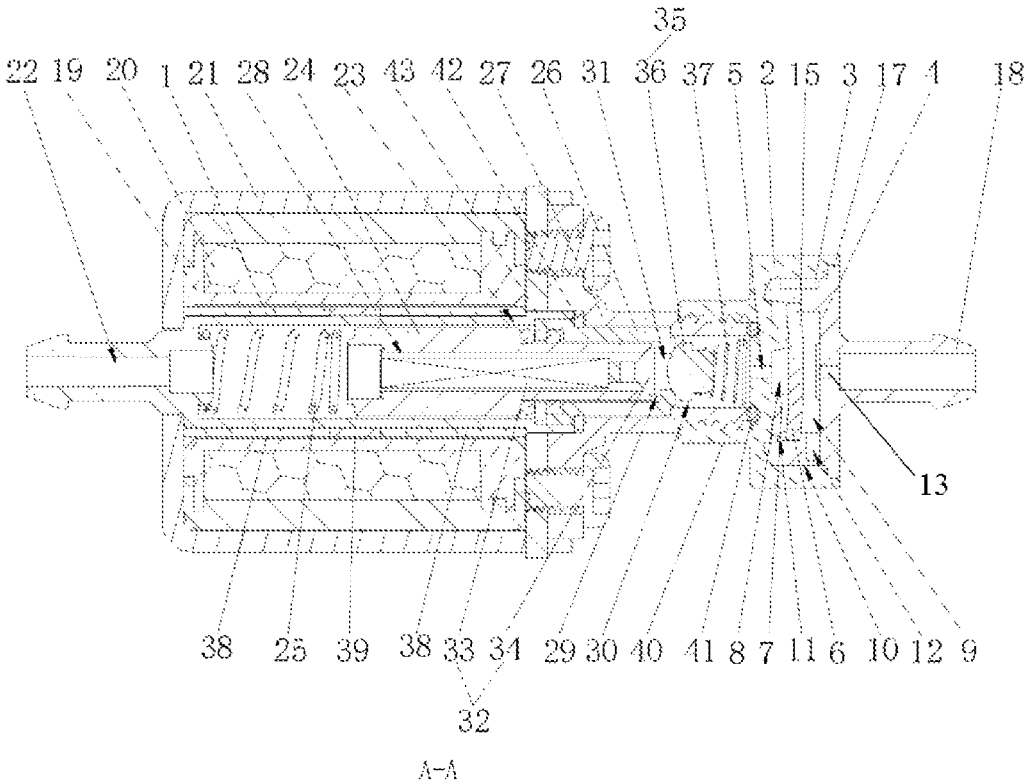
FIG. 2 is a cross-sectional view along the A-A plane of FIG. 1.
Figure 3:
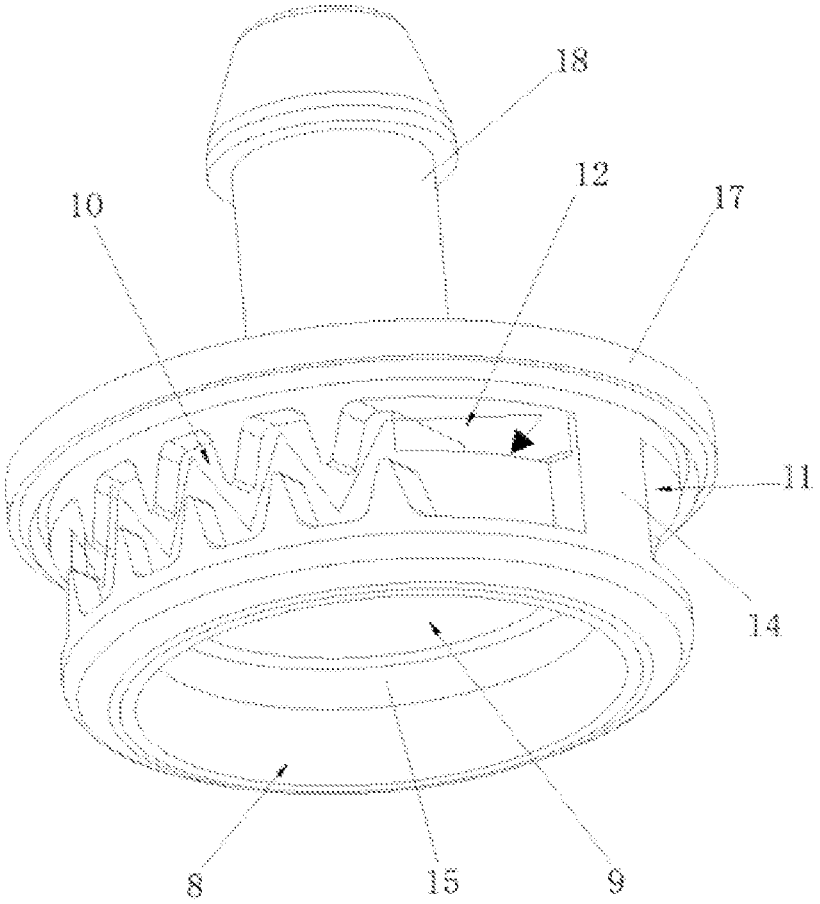
FIG. 3 is a schematic diagram of the structure of a throttle valve cover of the embodiment of the present utility model.

A miniature electromagnetic water pump, as shown in FIG. 1 to FIG. 3, includes a pump body 1, a magnetic core plunger device installed in the pump body 1, an electromagnetic device sleeved outside the pump body 1, and a throttle valve device connected with the magnetic core plunger device, the magnetic core plunger device is used to pump the liquid outside the pump body 1 to the throttle valve device, the electromagnetic device pushes the magnetic core plunger device to reciprocate in the pump body 1 by generating a pulsed electromagnetic field, the throttle valve device is beneficial to reduce the change in the size of the flow rate of the liquid discharged by the miniature electromagnetic water pump, and improve the stability and continuity of the flow rate of the liquid discharged from the miniature electromagnetic water pump.

As shown in FIG. 2 and FIG. 3, the throttle valve device includes a throttle valve seat 2, a containing groove 3 provided on the throttle valve seat 2, and a throttle valve cover 4 arranged in the containing groove 3, the throttle valve seat 2 is provided with a liquid inlet hole 5 for liquid to flow into the containing groove 3, the liquid inlet hole 5 is provided at the bottom of the containing groove 3, the cross section of the throttle valve cover 4 is concave, a rubber sheet 6 is clamped in the throttle valve cover 4, a flow restricting ring 7 is provided at the bottom of the containing groove 3, the flow restricting ring 7 is circumferentially arranged close to the opening edge of the liquid inlet hole 5, the flow restricting ring 7, the bottom of the containing groove 3 and the rubber sheet 6 define a first flow restricting cavity 8, a second flow restricting cavity 9 is enclosed by the side of the rubber sheet 6 away from the bottom of the containing groove 3 and the inner wall of the throttle valve cover 4, the inner side wall of the containing groove 3 and the outer side wall of the throttle valve cover 4 enclose a buffer channel 10, the side walls of the throttle valve cover 4 are respectively provided with a liquid inlet 11 and a liquid outlet 12, and the liquid inlet 11 communicates with the first flow restricting cavity 8 and the buffer channel 10, the liquid outlet 12 communicates with the second flow restricting cavity 9 and the buffer channel 10, a side of the throttle valve cover 4 away from the bottom of the containing groove 3 is provided with a liquid discharging opening 13 for discharging the liquid in the second flow restricting cavity 9.

The external liquid is pumped into the pump body 1 under the drive of the magnetic core plunger device, and the liquid in the pump body 1 is further pumped into the liquid inlet hole 5, and flow into the first flow restricting cavity 8 of the throttle valve device through the liquid inlet hole 5, the liquid in the first flow restricting cavity 8 further flows into the buffer channel 10 through the liquid inlet 11, flows into the second flow restricting cavity 9 through the liquid outlet 12, and is finally discharged from the liquid discharging opening 13.

In the present utility model, the rubber sheet 6 with certain elasticity is arranged in the throttle valve cover 4, when the pressure of the first flow restricting cavity 8 is greater than or less than the pressure of the second flow restricting cavity 9, the forces on both sides of the rubber sheet 6 are not equal, the rubber sheet 6 will bend in the direction away from the flow restricting ring 7 or close to the flow restricting ring 7, which increases or decreases the size of the gap between the rubber sheet 6 and the flow restricting ring 7, thereby increasing or reducing the flow rate of the liquid flowing from the first flow restricting cavity 8 into the buffer channel 10 per unit time, and then increasing or decreasing the flow rate of the liquid flowing from the buffer channel 10 into the second flow restricting cavity 9 per unit time, since the speed of the liquid flowing from the liquid inlet hole 5 into the first flow restricting cavity 8 remains basically unchanged, increasing or decreasing the liquid discharge velocity in the first flow restricting cavity 8 will correspondingly reduce or increase the pressure of the first flow restricting cavity 8, thus, the pressure in the first flow restricting cavity 8 is increased or decreased to be equal to the pressure in the second flow restricting cavity 9, at this time, the size of the gap between the rubber sheet 6 and the flow restricting ring 7 is in a stable state, and the pressure in the first flow restricting cavity 8 and the second flow restricting cavity 9 is also in a stable state, thus, the flow rate of the liquid discharged from the liquid discharging opening 13 of the second flow restricting cavity 9 is relatively stable.

Therefore, in the present utility model, the rubber sheet 6 with a certain elasticity is arranged in the throttle valve cover 4 such that the throttle valve device can be self-adjusted according to the pressure in the first flow restricting cavity 8 and the second flow restricting cavity 9 to keep the pressure in the second flow restricting cavity 9 in a stable state, thus, the flow rate of the liquid discharged from the liquid discharging opening 13 is stabilized, and since the liquid flows from the first flow restricting cavity 8 into the buffer channel 10 for buffering and deceleration and then flows into the second flow restricting cavity 9, the flow rate of the liquid flowing into the second flow restricting cavity 9 is lower, that is, the change in the flow rate of the liquid flowing into the second flow restricting cavity 9 per unit time is small, so that the pressure change in the second flow restricting cavity 9 per unit time is smaller, therefore, the change in the flow rate of the liquid discharged from the liquid discharging opening 13 is small. The buffer channel 10 also extends the flow path of the liquid, and the liquid filled in the buffer channel 10 can effectively improve the continuity of liquid discharge.

Specifically, as shown in FIG. 3, the buffer channel 10 is in the shape of a bend line, and the bend line-shaped buffer channel 10 has multiple corners, when the liquid flows in the buffer channel 10, it is blocked by the multiple corners to reduce the flow speed, thus, the flow rate of liquid flowing into the second flow restricting cavity 9 per unit time is reduced, as a result, the pressure change in the second flow restricting cavity 9 per unit time is relatively small, and the flow rate of the liquid discharged from the liquid discharging opening 13 finally changes relatively small. On the other hand, as the liquid flows in the bend line-shaped buffer channel 10, its flow rate is continuously reduced, furthermore, the flow rate of liquid flowing into the buffer channel 10 per unit time is greater than the flow rate of liquid discharged from the buffer channel 10 per unit time, so that the buffer channel 10 is always filled with liquid, thereby being beneficial to improve the continuity of liquid discharge.

Specifically, the outer side wall of the throttle valve cover 4 is provided with a flow blocking component 14 for preventing the liquid in the buffer channel 10 from flowing back into the liquid inlet 11, the flow blocking component 14 is arranged between the liquid inlet 11 and the liquid outlet 12. When the throttle valve cover 4 is installed in the containing groove 3, the side surface of the flow blocking component 14 away from the outer side wall of the throttle valve cover 4 abuts against the inner side wall of the containing groove 3, so that the liquid can only flow into the buffer channel 10 from the liquid inlet 11, and then flow into the liquid outlet 12 from the buffer channel 10 for drainage, the liquid in the buffer channel 10 will not flow back into the first flow restricting cavity 8 from the liquid inlet 11, thereby being beneficial to improve the liquid discharge stability of the miniature electromagnetic water pump.

Specifically, a limiting ring 15 is provided along the circumferential direction of the inner side wall of the throttle valve cover 4, the limiting ring 15 is used to block the movement of the rubber sheet 6 towards the liquid outlet 12, and the limiting ring 15 is arranged between the liquid inlet 11 and the liquid outlet 12. The setting of the limiting ring 15 can prevent the rubber sheet 6 from moving towards the second limiting cavity 9 due to the excessive pressure in the first limiting cavity 8, thereby avoiding the movement of the rubber sheet 6 to the position of the liquid outlet 12 (this movement causes the liquid outlet 12 to be blocked), which is beneficial to ensure the smooth operation of the throttle valve device and improve the stability and continuity of liquid discharge.

Specifically, as shown in FIG. 2 and FIG. 3, the throttle valve seat 2 is provided with an annular clamping groove (not shown in the figure), the clamping groove is circumferentially provided near the opening edge of the receiving slot 3, and a snap ring 17 is circumferentially provided on the outer side wall of the throttle valve cover 4 for snap-fitting with the clamping groove, this snap-fitting structure is convenient for users to disassemble the throttle valve cover 4 so as to replace or repair the throttle valve cover 4.

Specifically, in order to clearly show the position of the liquid discharge for the users, the throttle valve cover 4 is provided with a drip tube 18, one end of the drip tube 18 is connected to the liquid discharging opening 13.

As shown in FIG. 2, the electromagnetic device includes a framework 19 sleeved on the pump body 1, a coil 20 wound on the framework 19, and a housing 21 covering the coil 20. The coil 20 is externally connected to an AC power source, and during one cycle of the AC power source, positive or negative current is applied during half cycle, and no current is applied during the remaining half cycle.

The pump body 1 has a tubular structure with open ends, the two ends of the pump body 1 are the liquid inlet end 22 and the liquid outlet end 23, respectively, the magnetic core plunger device includes a core 24 slidably arranged in the pump body 1, a reset spring 25 connected to the liquid inlet end 22 of the pump body 1, which tends to move the core 24 toward the liquid outlet 23 of the pump body 1, a sleeve 26 arranged at the liquid outlet end 23 of the pump body 1, and a coupler 27 sleeved on the sleeve 26.

Specifically, the spring is arranged between the liquid inlet end 22 of the pump body 1 and the core 24, and when the reset spring 25 is in a natural state, the spring abuts the core 24. When the AC power supply externally connected to the coil 20 is in the half cycle of applying positive or negative current, the energized coil 20 generates a magnetic field force, and the generated magnetic field force drives the core 24 in the pump body 1 to move towards the liquid inlet end 22 of the pump body 1 and compress the reset spring 25, when the AC power supply is in the half cycle of applying no current, the coil 20 is de-energized, and the electromagnetic field force correspondingly disappears, so that the core 24 is pushed to move away from the liquid inlet end 22 of the pump body 1 under the action of the elastic force of the reset spring 25, thereby achieving the purpose of allowing the core 24 to reciprocate in the pump body 1.

Wherein, the core 24 is hollow inside and is formed with a flow channel 28 for liquid to flow through, the inner cavity between the end of the core 24 close to the discharge end 23 of the pump body 1 and the sleeve 26 constitutes a pressure cavity 29, one end of the coupler 27 close to the pump body 1 is fixedly connected to the housing 21 by bolts, and the other end extends in a direction away from the pump body 1 and forms a liquid outlet cavity 30 with the end of the sleeve 26 away from the pump body 1, an axial through hole 31 connecting the pressure cavity 29 and the liquid outlet cavity 30 is provided at one end of the sleeve 26 away from the pump body 1, the end of the coupler 27 away from the pump body 1 is connected to the throttle valve seat 2, and a first one-way valve 32 is provided at one end of the flow channel 28 close to the sleeve 26 for preventing the liquid in the liquid outlet cavity 30 from flowing back into the flow channel 28, a second one-way valve 35 is installed in the liquid outlet cavity 30 to prevent the liquid in the liquid outlet cavity 30 from flowing back into the pressure cavity 29, the liquid outlet cavity 30 is in communication with the containing groove 3 on the throttle valve seat 2 through the liquid inlet hole 5.

Since the first one-way valve 32 for preventing the liquid in the liquid cavity 30 from flowing back into the flow channel 28 is provided at one end of the flow channel 28 close to the sleeve 26, and the second one-way valve 35 is installed in the liquid outlet cavity 30 to prevent the liquid in the liquid outlet cavity 30 from flowing back into the pressure cavity 29, when the core 24 moves towards the liquid inlet end 22 of the pump body 1 under the action of the magnetic field force generated by the energized coil 20, the increase in the volume of the pressure cavity 29 formed between the first one-way valve 32 and the second one-way valve 35 causes the pressure in the pressure cavity 29 to decrease, at this time, the atmospheric pressure outside the miniature electromagnetic water pump is greater than the pressure in the pressure cavity 29, and the liquid outside the electromagnetic water pump enters the flow channel 28 of the core 24 through the liquid inlet end 22 of the water pump due to the pressure difference. The first one-way valve 32 is opened under the pressure difference so that the liquid flows from the flow channel 28 of the core 24 to the pressure cavity 29, when the alternating current is in the half cycle with no current, due to the disappearance of the electromagnetic field force, the core 24 moves in the direction of the pressure cavity 29 under the action of the reset spring 25, that is, it moves away from the liquid inlet end 22 of the pump body 1. The pressure in the pressure cavity 29 increases due to the decrease in its volume. When the pressure in the pressure cavity 29 is stronger than the pressure in the outlet cavity 30, the second one-way valve 35 is opened under the pressure of the pressure cavity 29, so that the liquid in the pressure cavity 29 flows from the circumferential through hole of the sleeve 26 into the liquid outlet cavity 30, and flows into the throttle valve device through the liquid inlet channel of the throttle valve seat 2. Working in this cyclical way, the water absorption and drainage process of the electromagnetic water pump are provided, so that the electromagnetic water pump can continuously discharge water.

Specifically, the first one-way valve 32 includes a tension spring 33 and a valve core 34 for blocking the opening of the flow channel 28 near the pressure cavity 29, the tension spring 33 is arranged between the liquid inlet end 22 of the pump body 1 and the valve core 34, and two ends of the tension spring 33 are respectively connected to the core 24 and the valve core 34, the valve core 34 is located at the opening of one end of the flow channel 28 close to the pressure cavity 29, the tension spring 33 exerts a tension on the valve core 34 so that the liquid flows from the first one-way valve 32 into the pressure cavity 29, the tension spring 33 can pull the valve core 34 to return the valve core 34 to its original position in time and block the flow channel 28 so that the liquid in the pressure cavity 29 cannot flow back into the flow channel 28.

Wherein, the second one-way valve 35 is provided at the connection between the axial through hole 31 of the sleeve 26 and the liquid outlet cavity 30, the second one-way valve 35 includes a sealant head 36 and a tower spring 37, the two ends of the tower spring 37 are respectively connected to the sealant head 36 and the coupler 27, the sealant head 36 is arranged between the sleeve 26 and the tower spring 37. The tower spring 37 applies a force to the sealant head 36 towards the sleeve 26, so that the sealant head 36 abuts against the sleeve 26 and blocks the circumferential through hole, when the pressure of the pressure cavity 29 in the sleeve 26 increases, the fluid in the pressure cavity 29 can overcome the pressure of the second one-way valve 35 to flow out from the pressure cavity 29, but the fluid in the liquid outlet cavity cannot flow back into the pressure cavity 29.

Wherein, a magnetic yoke ring 38 is provided between the framework 19 and the pump body 1. Preferably, two magnetic yoke rings 38 are provided, and a bushing 39 is also provided between the two magnetic yoke rings 38.

Wherein, the side of the throttle valve seat 2 close to the coupler 27 is provided with a connecting part 40 for connecting with the coupler 27, the connecting part 40 is threaded to the coupler 27, thereby facilitating the assembly of the coupler 27 and the throttle valve device and facilitating the maintenance or replacement of the throttle valve.

Specifically, the connecting part 40 is a tubular structure with one end fixedly connected to the throttle valve seat 2, and the liquid inlet hole 5 is located in the connecting part 40, the inner wall of the connecting part 40 is provided with an internal thread (not shown in the figure), and the outside of the coupler 27 is provided with an external thread (not shown in the figure) matching the internal thread.

Specifically, a first sealing ring 41 is provided between the connecting part 40 and the coupler 27, the first sealing ring 41 is used to block the liquid in the liquid outlet cavity 30 from flowing to the gap between the connecting part 40 and the coupler 27.

Specifically, a second sealing ring 42 is provided between the coupler 27 and the sleeve 26 to improve the sealing performance between the sleeve 26 and the coupler 27, and the liquid in the pressure cavity 29 is prevented from flowing out via the gap between the sleeve 26 and the coupler 27.

Furthermore, a third sealing ring 43 is provided between the sleeve 26 and the core 24 to improve the sealing performance between the sleeve 26 and the core 24, thereby preventing the liquid in the pressure cavity 29 from flowing back to the liquid inlet end 22 of the pump body 1 from the gap between the sleeve 26 and the core 24.

The above is the detailed description of the preferred implementation of the present utility model, but the present utility model is not limited to the described embodiments, those skilled in the art can make various equivalent modifications or substitutions without departing from the spirit of the present utility model, and these equivalent modifications or substitutions are all included in the scope defined by the claims of this application.

The invention claimed is:

1. A miniature electromagnetic water pump, comprising a pump body, a magnetic core plunger device installed in the pump body, an electromagnetic device sleeved outside the pump body, and a throttle valve device connected with the magnetic core plunger device, wherein the magnetic core plunger device is used to pump liquid outside the pump body to the throttle valve device, the electromagnetic device generates a pulsed electromagnetic field to push the magnetic core plunger device to reciprocate in the pump body;

wherein the throttle valve device comprises a throttle valve seat, an containing groove provided on the throttle valve seat, and a throttle valve cover arranged in the containing groove, the throttle valve seat is provided with a liquid inlet hole for liquid to flow into the containing groove, the cross section of the throttle valve cover is in a concave shape, a rubber sheet is clamped in the throttle valve cover, a flow restricting ring is circumferentially provided in the containing groove close to an opening edge of the liquid inlet hole, and wherein the flow restricting ring, the containing groove and the rubber sheet define a first flow restricting cavity, a second flow restricting cavity is enclosed by a side of the rubber sheet away from the liquid inlet hole and an inner wall of the throttle valve cover, and a buffer channel is enclosed by an inner side wall of the containing groove and an outer side wall of the throttle valve cover, the first flow restricting cavity and the second flow restricting cavity are respectively communicated with a liquid inlet and a liquid outlet of the buffer channel, the throttle valve cover is provided with a liquid discharging opening for the liquid in the second flow restricting cavity to be discharged from the throttle valve device.

2. The miniature electromagnetic water pump of claim 1, wherein the electromagnetic device comprises a framework sleeved outside the pump body, a coil wound on the framework, and a housing covering the coil.

3. The miniature electromagnetic water pump of claim 2, wherein a magnetic yoke ring is provided between the framework and the pump body.

4. The miniature electromagnetic water pump of claim 2, wherein the pump body has a tubular structure with two open ends, the two open ends of the pump body are a liquid inlet end and a liquid outlet end respectively, the magnetic core plunger device comprises a core slidably arranged in the pump body, a reset spring connected to the liquid inlet end of the pump body, which tends to move the core toward the liquid outlet end of the pump body, a sleeve arranged at the liquid outlet end of the pump body, and a coupler sleeved on the sleeve, and wherein the core is hollow inside and formed with a flow channel for liquid to flow through, and an inner cavity between the end of the core close to the liquid outlet end of the pump body and the sleeve constitutes a pressure cavity, one end of the coupler close to the pump body is fixedly connected to the housing, and the other end extends in a direction away from the pump body and forms a liquid outlet cavity with the end of the sleeve away from the pump body, an axial through hole connecting the pressure cavity and the liquid outlet cavity is provided at the end of the sleeve away from the pump body, and the end of the coupler away from the pump body is connected to the throttle valve seat, a first one-way valve is provided at one end of the flow channel close to the sleeve for preventing the liquid in the liquid outlet cavity from flowing back into the flow channel, a second one-way valve is installed in the liquid outlet cavity to prevent the liquid in the liquid outlet cavity from flowing back into the pressure cavity, and the liquid outlet cavity and the containing groove on the throttle valve seat are communicated through the liquid inlet hole.

5. The miniature electromagnetic water pump of claim 4, wherein, the first one-way valve comprises a tension spring and a valve core, the tension spring is arranged between the liquid inlet end of the pump body and the valve core, and two ends of the tension spring are respectively connected to the core and the valve core.

6. The miniature electromagnetic water pump of claim 4, wherein, the second one-way valve is arranged at the connection between the axial through hole of the sleeve and the liquid outlet cavity, the second one-way valve comprises a sealant head and a tower spring, two ends of the tower spring are respectively connected with the sealant head and the coupler, and the sealant head is arranged between the sleeve and the tower spring.

7. The miniature electromagnetic water pump of claim 4, wherein, the throttle valve seat is provided with a connecting part on one side close to the coupler for connecting with the coupler, and the connecting part is threaded to the coupler.

8. The miniature electromagnetic water pump of claim 7, wherein, a first sealing ring is provided between the connecting part and the coupler, and the first sealing ring is used to block the liquid in the liquid outlet cavity from flowing to a gap between the connecting part and the coupler.

9. The miniature electromagnetic water pump of claim 1, wherein, the buffer channel is in the shape of a bend line.

10. The miniature electromagnetic water pump of claim 1, wherein, the outer side wall of the throttle valve cover is provided with a flow blocking component for preventing the liquid in the buffer channel from flowing back into the liquid inlet, and the flow blocking component is arranged between the liquid inlet and the liquid outlet.

* * * * *